US006705222B2

(12) United States Patent
Norman et al.

(10) Patent No.: US 6,705,222 B2
(45) Date of Patent: Mar. 16, 2004

(54) DUAL REGISTRATION CONTROL SYSTEM

(75) Inventors: Ronald J. Norman, Parkton, MD (US); Jack E. Simon, Brodbecks, PA (US)

(73) Assignee: Ward, Inc., Jefferson, MO (US)

( * ) Notice: Subject to any disclaimer, the term of this patent is extended or adjusted under 35 U.S.C. 154(b) by 152 days.

(21) Appl. No.: 09/801,580

(22) Filed: Mar. 9, 2001

(65) Prior Publication Data

US 2002/0124750 A1 Sep. 12, 2002

(51) Int. Cl.[7] ..... B41F 5/16
(52) U.S. Cl. ..... 101/248; 101/183; 101/484
(58) Field of Search ..... 101/248, 483, 101/484, 486, 142, 177, 183, 217, 232

(56) References Cited

U.S. PATENT DOCUMENTS 4,527,788 A * 7/1985 Masuda ..... 101/248
5,103,733 A * 4/1992 Drapatsky et al. ..... 101/485
5,383,392 A * 1/1995 Kowalewski ..... 101/183
5,385,091 A * 1/1995 Cuir et al. ..... 101/217
5,606,913 A * 3/1997 Kowalewski ..... 101/183
5,873,307 A * 2/1999 Tenfelde et al. ..... 101/248
5,924,362 A * 7/1999 Volz et al. ..... 101/183
6,095,043 A * 8/2000 Hartmann et al. ..... 101/183

* cited by examiner

*Primary Examiner*—Eugene H. Eickholt
(74) *Attorney, Agent, or Firm*—Ronald B. Sherer; Bartlett & Sherer

(57) ABSTRACT

A rotary printing machine is disclosed comprising a conveyor for conveying sheets of material from an upstream cylinder to a downstream conveyor in which the angular positions of both conveyors are sensed, as well as the linear position of each sheet, and the speed of the conveyor is adjusted to maintain registry of each sheet.

6 Claims, 2 Drawing Sheets

DUAL REGISTRATION CONTROL SYSTEM

FIELD

This invention relates to rotary printing of images on a series of sheets passed through a printing machine, including at least one conveyor, while maintaining registry of the sheets with respect to rotary cylinders positioned both upstream and downstream of the conveyor.

BACKGROUND AND SUMMARY

In the art of rotary printing, those machines which print on individual, separated sheets passing successively through the machine inherently have a critical problem of registration control which is not present in web-type printing machines. That is, in order to produce clean and sharp images, the linear position of each sheet must be in perfect registry with the angular positions of the rotary cylinders positioned both upstream and downstream of the conveyor, including registry with the rotary cylinder which is in engagement with the sheet at that precise time. Otherwise, the printed images on the sheets become blurred and may be totally unacceptable.

U.S. Pat. No. 5,383,392 discloses a registration control system which has been a significant advance in the rotary printing art. This control system is designed for use when several of the rotary cylinders are driven by separate servo motors with each of the servo motors being individually controlled by the control system. However, as is well known in the rotary printing art, servo motors are extremely expensive, and no solution to the critical registration problem is known for rotary printing machines in which the various rotary cylinders are driven through a gear train by a single drive motor. This type of gear drive system with a single motor is much less costly than a plurality of independent servo motors; however, the critical problem of inaccurate registration because of the unavoidable backlash in the gear train has never been satisfactorily solved.

The present invention solves this long-standing problem by sensing the angular positions of the cylinders both upstream and downstream of the conveyor, and adjusting the speed of the conveyor in accordance with these sensed conditions, as well as, the sensed linear position of each sheet.

DETAILED DESCRIPTION

Figure 1:
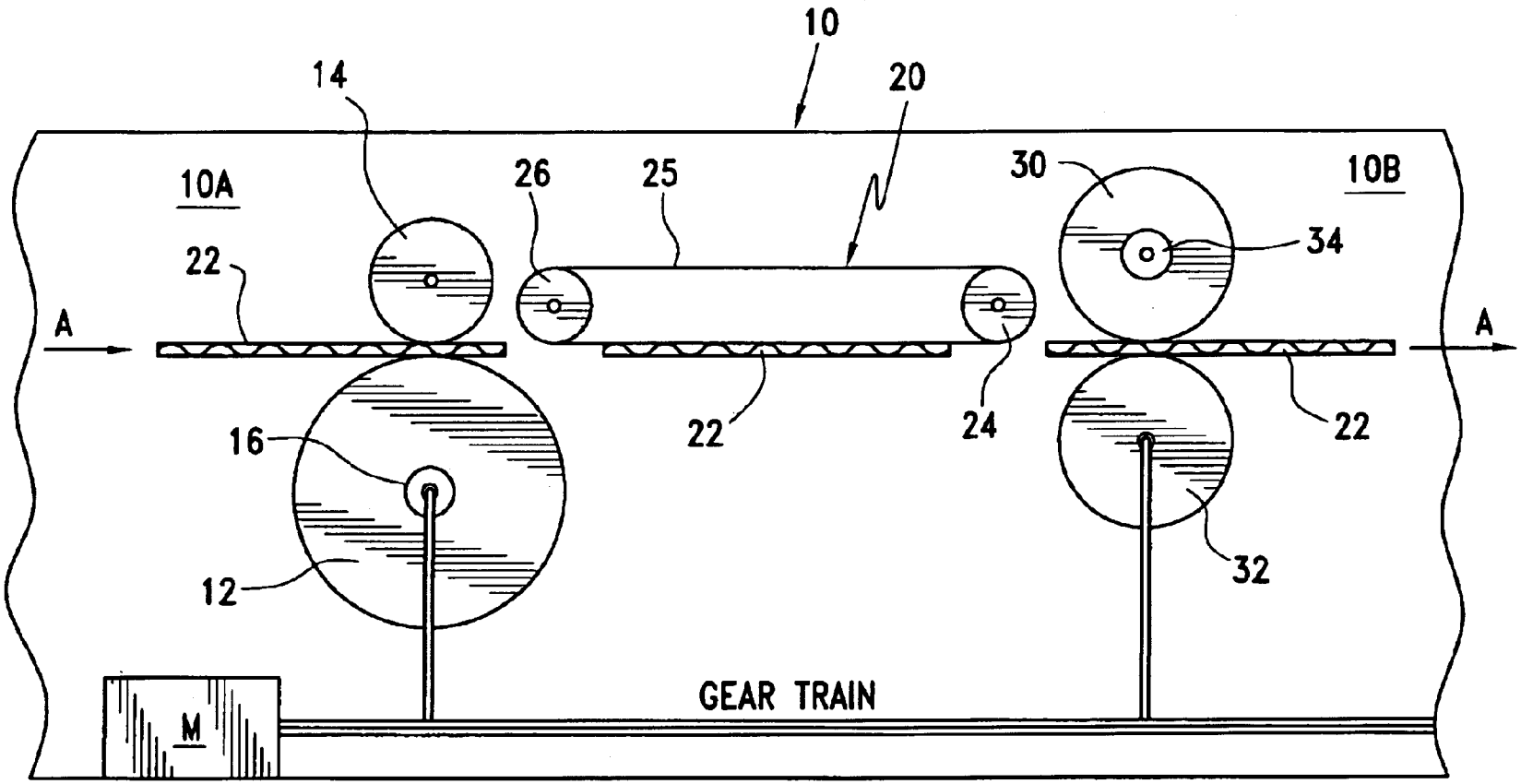
FIG. 1 is a schematic diagram illustrating upstream and downstream stages of a rotary printing machine with a transfer conveyor positioned between the two stages.

In FIG. 1, numeral 10 represents a rotary printing machine having at least two stages 10A and 10B. In the embodiment illustrated, by way of example, numeral 12 indicates a rotary printing cylinder and the impression cylinder is indicated by numeral 14. Cylinder 12 includes an encoder 16 which is mounted on the cylinder or on the cylinder drive shaft. Encoder 16 senses the angular position of this cylinder and produces a signal indicative of its angular position at all times.

Numeral 20 indicates a conveyor system for conveying sheets 22 from left to right as indicated by arrows A and, in the preferred embodiment, sheets 22 comprise blanks of corrugated cardboard to be imprinted. Many forms of conveyors will be apparent to those skilled in the art, and for illustration purposes only, conveyor system 20 is illustrated as comprising a plurality of drive pulleys 24, belts 25 and idler pulleys 26 spaced laterally across the width of the machine perpendicular to the direction of travel of the sheets. Sheets 22 firmly engage the bottom reach of the belts by virtue of a differential pressure above and below the sheets as is well known in the conveyor art. Alternatively, the sheets may be carried by the upper reaches of the belts, and/or by conveyor rollers as is also well known in the conveyor art. In the embodiment illustrated in FIG. 1, for purposes of example, print cylinder 12 and conveyor system 20 are followed downstream in the direction of movement of the sheets by a die cutter 30 and a backing cylinder 32. However, it is to be understood that cylinder 32 may be a subsequent printing cylinder with cylinder 30 being an impression cylinder. Also, it is to be understood that cylinders 12 and 14 may be feed rollers for feeding the sheets into a first stage of printing comprising cylinders 30, 32. Accordingly, cylinders 12 and 14 will be hereinafter referred to as the "upstream cylinders", and cylinders 30 and 32 will be referred to as the "downstream cylinders".

As further illustrated in FIG. 1, downstream cylinder 30 carries an encoder 34 which continuously senses the angular position of cylinder 30 and sends a signal indicative of the precise angular position of the cylinder at all times.

Figure 2:
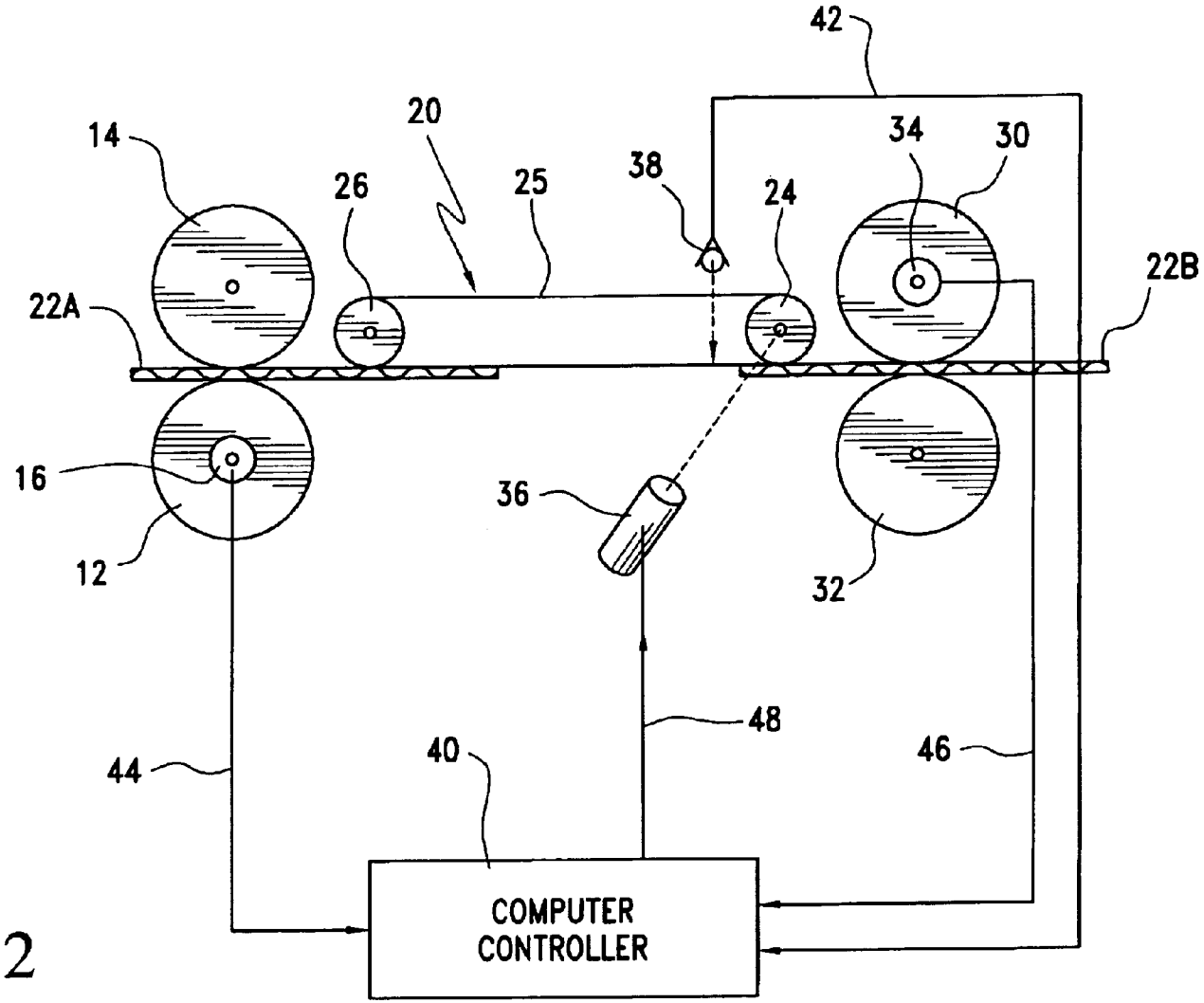
FIG. 2 is a schematic diagram of the basic elements of the dual control system.

Referring to FIG. 2, the same elements are indicated by the same numerals as previously described. In addition, the control system includes a servo motor 36 driving the conveyors, a position sensor 38 and a computer controller 40. Position sensor 38 may be of any type capable of detecting the leading edges of the sheets, or imprints thereon, and sending a signal 42 indicative thereof to the controller. Controller 40 also receives a signal 44 from encoder 16 which indicates the precise angular position of cylinder 12, and it receives a signal 46 indicating the precise angular position of cylinder 30 as sensed by encoder 34. An output signal 48 is generated by the controller and is sent to servo motor 36 to increase or decrease the speed of servo motor 36. Thus, servo motor 36 adjusts the linear position of the belts so as to advance or retard the linear position of each sheet as is required to maintain registry with both the upstream cylinder 14 and downstream cylinder 30.

The sequence of operations is as follows and begins when a sheet 22A is between cylinders 12, 14 as shown in FIG. 2. At this time, the angular position of cylinder 12 is continuously fed to controller 40, and an output signal 48 is sent to servo motor 36 so as to establish the correct speed of the conveyor to receive the sheet on the conveyor as determined by the angular position of cylinder 12. This condition continues until position sensor 38 senses the leading edge of, or an imprint on, sheet 22A. The timing of this occurrence is sent as signal 42 to the controller. This signal overrides signal 44, and the computer then compares the time/position of sheet 22A, sensed by sensor 38, with the angular position of downstream cylinder 30 sensed by encoder 34. If the controller detects that this sheet is either advanced or retarded relative to the linear position of the sheet which is required in order to be in register with cylinder 30, then controller output signal 48 corrects the linear position of sheet 22A by decreasing or increasing, respectively, the speed of the conveyor. In this manner, the first registration control of each sheet is maintained as a function of the angular position of an upstream cylinder, and each sheet is subsequently controlled as a function of the next downstream cylinder. Thus, the system is capable of double or dual control of each sheet and can thereby compensate for positional errors of each sheet whether caused by slippage on the belts, backlash between gears in the drive train, or any other factor creating improper registration between first and second rotary cylinders.

From the foregoing description it will be apparent that many modifications and variations of the invention will become apparent to those skilled in the art. Accordingly, it is to be understood that the foregoing description of one preferred embodiment is intended to be illustrative rather than exhaustive of the principles of the invention, and that the scope of the invention is not intended to be limited other than as set forth in the following claims interpreted under the doctrine of equivalents.

What is claimed is:

1. A printing machine comprising in combination:

(a) an upstream rotary cylinder;

(b) a downstream rotary cylinder;

(c) transfer means for transferring successive sheets of material from said upstream cylinder to said downstream cylinder;

(d) at least one of said cylinders being a rotary print cylinder carrying a printing plate;

(e) first and second angular position sensors connected to said upstream and downstream cylinders, respectively;

(f) computer control means connected to receive inputs from said first and second sensors and including output signal means connected to said transfer means, for adjusting the speed of said transfer means as a dual function of said first and second angular position sensors; and (g) wherein said upstream cylinder is a feed cylinder.

2. A printing machine comprising in combination:

(a) an upstream rotary cylinder;

(b) a downstream rotary cylinder;

(c) single motor drive means driving both of said upstream and downstream cylinders;

(d) elongated transfer means for transferring successive sheets of material from said upstream cylinder to said downstream cylinder;

(e) at least one of said cylinders being a rotary print cylinder carrying a printing plate;

(f) first and second angular position sensors connected to said upstream and downstream cylinders, respectively; and (g) computer control means connected to receive inputs from said first and second sensors, and including output signal means connected to said elongated transfer means, for adjusting the, speed of said elongated transfer means as a dual function of said first and second angular position sensors.

3. The printing machine of claim 2, which said downstream cylinder is a die cutting cylinder.

4. The printing means of claim 2, further including sensor means for sensing the actual position of each sheet as each sheet is transferred by said elongated transfer means.

5. The printing mean of claim 4 wherein said sensor means comprises means for sensing the position of the loading portion of each sheet as it approaches said downstream rotary cylinder.

6. The printing machine of claim 5 wherein said elongated transfer means comprise at least one elongated conveyor belt, and said elongated conveyor belt is driven by a servo motor which receives a signal from said computer control means.

* * * * *